United States Patent [19]

Smith

[11] Patent Number: 4,895,675

[45] Date of Patent: Jan. 23, 1990

[54] NEUTRAL PH WHEEL CLEANER

[75] Inventor: Ray E. Smith, Orlando, Fla.

[73] Assignee: Pro-Max Performance, Inc., Longwood, Fla.

[21] Appl. No.: 287,120

[22] Filed: Dec. 21, 1988

[51] Int. Cl.[4] ..... C11D 3/065

[52] U.S. Cl. ..... 252/539; 252/139; 252/173; 252/557; 252/DIG. 14

[58] Field of Search ..... 252/536, 537, 538, DIG. 14, 252/557

[56] References Cited

U.S. PATENT DOCUMENTS

| | | | |
|---|---|---|---|
| 2,995,524 | 8/1961 | Wylie et al. | 252/537 |
| 4,670,171 | 6/1987 | Magyar | 252/DIG. 14 |
| 4,772,425 | 9/1988 | Prouix et al. | 252/DIG. 14 |

*Primary Examiner*—Prince E. Willis
*Assistant Examiner*—Alex Ghyka
*Attorney, Agent, or Firm*—Macdonald J. Wiggins

[57] ABSTRACT

An essentially neutral pH vehicle wheel cleaner for coated alloy vehicle wheels includes a builder, a surfactant, a buffer, a clarifier or mild abrasive, and a fragrance in water. The builder and surfactant interact to produce strong buffering to prevent a significant change in pH due to alkaline brake dust, road soil, and acidic road salts. A preferred embodiment utilizes tetrapotassium pyrophosphate as the builder, a sodium salt of sulfonated oleic acid as the buffer, and a ethylene oxide adduct of octylphenol as the surfactant. Various fragrances are disclosed.

10 Claims, No Drawings

NEUTRAL PH WHEEL CLEANER

BACKGROUND OF THE INVENTION

1. Field of the Invention

The present invention relates to automobile wheel cleaning, and more particularly to a wheel cleaner having a neutral pH and an internal buffering ability to neutralize effects of brake dust and road acids or alkalies.

2. Description of the Prior Art

Modern, highly styled automobiles may have wheels formed from light metal alloys, predominately aluminum. These alloys are sensitive to highly acidic and highly alkaline substances which can cause damage thereto. Therefore, such wheels are given a protective coating by the manufacturer. All vehicle and aftermarket wheel manufacturers recommend frequent cleaning of the wheels to prevent build up of harmful materials. For example, heated particles from brake pads and discs bombard the coated wheel surfaces, producing a highly adhesive, rough build up. Dirt from roads and unpaved areas easily adhere to the rough build up, and contain salts and acids. In the presence of moisture, the coatings become destroyed and severe damage of the wheels follows.

Brake dust may have a pH in the range of 8 to 10, while road salt may produce an acid pH in the 3 to 4 range, and soil and dirt an alkaline pH of 8 to 10. The adhesive build up cannot be removed by high pressure water alone, and a cleaner must be used. The cleaner itself must not be highly acid or alkaline to prevent damage to the protective wheel coatings.

A survey of 14 commercially available wheel cleaners indicated pH values over a range of 1.0 to 13.5. Considering values of pH between 6 and 8 to be satisfactory, only one of those tested fell within this range. It is also important that, during use of a cleaner, acidic or alkaline soil being removed does not significantly change the cleaner pH. Therefore, in addition to measurement of pH, each cleaner was tested to determine the effectiveness of any buffering properties by adding acid and alkali to each. The one acceptable cleaner, which was essentially neutral, had no neutralizing action, having a pH of 1.5 for added acid and 12.5 for added alkali.

There is an unfilled need for a cleaner for coated alloy wheels having a pH in the 6–8 range, which includes effective buffering for both acid and alkali contaminants.

SUMMARY OF THE INVENTION

The present invention is an improved coated alloy wheel cleaner which is essentially neutral pH in the range of pH 7.5+0.5 and which provides strong buffering action for acid and alkalis. The cleaner may be considered as a detergent and emulsifier; and includes water, a builder, a surfactant, a stabilizer, a clarifier or mild abrasive, and a fragrance. The formulation is an excellent hard surface cleaner which is safe to use on clear coated alloy wheels and painted surfaces. The preferred builder and surfactant interact to produce strong buffering. With 10 cc of 0.1N hydrochloric acid added to 50 grams of the cleaner of the invention, a pH of 7.7 changed to 7.8. When 10 cc of 0.25N sodium hydroxide was added to 25 grams of the cleaner, the pH increased to 8.6. These tests indicate the efficiency of the buffering action.

It is therefore a principal object of the invention to provide a cleaner of alloy and coated vehicle wheels having an essentially neutral pH and which is buffered against the action of acidic brake dust and alkaline road buildup.

It is another object of the invention to provide a vehicle wheel cleaner which will not harm alloy wheels or protective coatings on such wheels.

These and other objects and advantages of the invention will become evident from the following detailed description.

DETAILED DESCRIPTION OF THE PREFERRED EMBODIMENT

The preferred embodiment of the invention contains a surfactant agent, a builder, a solubilizer, a clarifier and a fragrance in a water solution. However, as will be discussed hereinbelow, certain omissions and substitutions may be made.

EXAMPLE 1

1. The builder, used in a preferred formulation, may be selected from the group of alkali metal phosphates comprising: sodium tripolyphosphate; tetrasodium pyrophosphate; sodium hexametaphosphate; trisodium phosphate; potassium tripolyphosphate; tripotassium phosphate; and tetrapotassium pyrophosphate. Water, in an amount of 54.4%±5% by weight, has 10% ±4% by weight of builder dissolved therein which produces a pH in excess of 10. A preferred builder is tetrapotassium pyrophosphate, available as TKPP from FMC corporation of Philadelphia, Pa.

2. A solubilizer and buffer, the sodium salt of sulfonate oleic acid is mixed in an amount of 25% +10% by weight which adjusts the pH to 7.5 ±0.5, acts as part of a buffer system, and performs as a solubilizing agent for stability and uniformity. The preferred product is sold under the trade name SUL-FON-ATE OA-5 by Tennessee Chemical Co., Atlanta, GA.

3. An anionic, nonionic, or amphotoric surfactant is added. A biodegradable anionic surfactant may be selected from the group comprising: sodium salts of sulfonated dodecylbenzene and; potassium salts of sulfonated dodecylbenzene; A preferred anionic surfactant useful in this invention is Calsoft F-90 sold by Pilot Chemical of Santa Fe Springs, CA 90670 which is added in an amount of 10%±3% by weight. A preferred nonionic surfactant is a 9–10 mole ethylene oxide adduct to either octylphenol or nonylphenol. Surfonic N-100, available from Texaco Chemical Co. of Dellaire, Texas, is a suitable nonionic surfactant and is added in an amount of 10%±3% by weight. The nonionic surfactants are not soluble in solutions containing high concentrations of dissolved electrolytes. In the present formulation, the SUL-FON-ATE OA5 used to adjust the pH is a hydrotrope and solubilizing agent, and also serves to dissolve the nonionic surfactant in a high concentration of dissolved electrolytes. The unique solubility characteristic produces a synergistic effect resulting in improved cleaning.

4. A clarifier selected from the group comprising: ethylene glycol; glycerine; butyl cellosolve; hexylene glycol; and isopropyl alcohol may be added in an amount from 0% to 10% by weight. The clarifier serves to add "sparkle" to the formulation and to improve freeze-thaw and heat stability.

EXAMPLE 2

The formulation of EXAMPLE 1 has 1% to 10% by weight of an abrasive added thereto. The abrasive is selected from the group comprising: a natural diatomite; and a flux calcined diatomite. Natural diatomite is available as Kaopolite SF from Kaopolite, Inc., Union, New Jersey, and flux calcined diatomite is sold by Manville Products, Denver, Colorado. The abrasives have a particle size of 0.5 to 1.0 microns and a Mohs hardness in the range of 4 to 8.

EXAMPLE 3

The formulations of EXAMPLES 1 and 2 have a bland, natural odor. A fragrance selected from the group comprising: primary amylacetate, pine oil; cherry scents; and citrus scents is added to the formulation of EXAMPLE 1 and EXAMPLE 2 in an amount of 0.1% to 1.0% by weight.

As will be understood, when the preferred formulation is used, the user sprays the full strength liquid onto a cool, dry wheel surface. At that point, the cleaner begins to neutralize any high pH brake dust and road soil to within the 7 to 8 pH range. Similarly, road salt which may be acidic is also neutralized to the desired pH range. The neutralizing action requires about 6 to 8 minutes. After this period, the cleaner is rinsed off with clear water with he detergent action removing the brake dust, road soil and road salt.

Although specific formulations of the wheel cleaner of the invention have been shown, these are for exemplary purposes and various changes in percentages and elements thereof may be made without departing from the spirit and scope of the invention.

I claim:

1. A wheel cleaner for alloy and coated metal vehicle wheels comprising:

water in an amount of 54.5%±5% by weight;

a builder dissolved therein, said builder selected from the group consisting of tetrapotassium phosphate, tetrasodium pyrophosphate, trisodium phosphate, sodium tripolyphosphate, potassium tripolyphosphate, and trisodium phosphate;

sodium salt of sulfonate oleic acid added to said solution in an amount of 25%±10% by weight to adjust the pH of said solution to 7.5±0.5 by weight; and an anionic surfactant selected from the group consisting of sodium salts of sulfonated dodecylbenzene and potassium salts of sulfonated dodecylbenzene in an amount of 10%±3% by weight.

2. The cleaner as recited in claim 1 which further comprises a clarifier added in an amount less than 10% by weight selected from the group consisting of ethylene glycol, glycerine, butyl cellosolve, hexylene glycol, and isopropyl alcohol.

3. The cleaner as recited in claim 1 which further includes an abrasive selected from the group consisting of diatomite, and flux calcined diatomite.

4. The cleaner as recited in claim 3 in which said abrasive has a particle size in the range of 0.5 to 1.0 microns.

5. The cleaner as recited in claim 3 in which said abrasive has a Mohs hardness in the range of 4 to 8.

6. The cleaner as recited in claim 1 in which a fragrance selected from the group consisting of primary amyl acetate, pine oil, cherry scent, and citrus scent is added thereto in an amount of 0.1% to 1.0% by weight.

7. As essentially neutral pH vehicle wheel cleaner comprising:

(a) water in an amount of 55%±5% by weight;

(b) a builder in an amount of 10%±4% by weight dissolved in said water, said builder selected from the group consisting of tetrapotassium phosphate, tetrasodium pyrophosphate, trisodium phosphate, sodium tripolyphosphate, potassium tripolyphosphate, and trisodium phosphate;

(c) sodium salt of sulfonate oleic acid buffer and solubilizer added to said solution in an amount to adjust the pH of said solution to 7.5±0.5; and (d) a nonionic surfactant in an amount of 10%±3% by weight selected from the group consisting of a 9–10 mole ethylene oxide adduct to octylphenol, and a 9–10 mole ethylene oxide adduct to nonylphenol.

8. The cleaner as recited in claim 7 which further comprises a clarifier selected from the group consisting of ethylene glycol, clycerine, butyl cellosolve, hexylene glycol, and isopropyl alcohol in an amount of less than 10% by weight added thereto.

9. The cleaner as recited in claim 7 which further comprises a natural diatomite in an amount of 1% to 10% by weight added thereto.

10. The cleaner as recited in claim 7 which further comprises a flux calcined diatomite in an amount of 1% to 10% by weight added thereto.

* * * * *